United States Patent [19]

Boisseau

[11] Patent Number: 4,930,291

[45] Date of Patent: Jun. 5, 1990

[54] PROCESS FOR THE HORIZONTAL UNIT DISTRIBUTION OF BLANKS

[75] Inventor: Jean-Louis Boisseau, Sainte Savine, France

[73] Assignee: Vega Automation, La Chapelle Saint Luc, France

[21] Appl. No.: 157,244

[22] Filed: Feb. 18, 1988

[30] Foreign Application Priority Data

Feb. 18, 1987 [FR] France ..... 87 02097

[51] Int. Cl.[5] ..... B65B 43/46

[52] U.S. Cl. ..... 53/458; 53/168; 53/564

[58] Field of Search ..... 53/168, 458, 457, 566, 53/564; 493/478, 181, 122

[56] References Cited

U.S. PATENT DOCUMENTS

| | | | |
|---|---|---|---|
| 3,137,981 | 6/1964 | Johnson et al. | 53/168 |
| 3,566,577 | 3/1971 | Occhipinti | 53/168 X |
| 3,952,636 | 4/1976 | Reichert | 493/181 X |
| 4,633,650 | 1/1987 | Sohlberg et al. | 53/168 X |

*Primary Examiner*—James F. Coan

*Attorney, Agent, or Firm*—Mason, Fenwick & Lawrence

[57] ABSTRACT

A process for transferring and packaging contents into containers is disclosed wherein container blanks of various formats are arranged in vertical stacks in various magazines such that a selected container blank is withdrawn from the bottom of its associated magazine and moved continuously by a conveyor means and is formed into a container and subsequently filled with contents. Continuous packaging of the contents in containers of different dimensions is effected without standstill times attributable to changing the format of the blanks.

13 Claims, 2 Drawing Sheets

PROCESS FOR THE HORIZONTAL UNIT DISTRIBUTION OF BLANKS

The invention relates to a process and an apparatus for the unit storage and distribution of blanks intended more particularly for packaging and forced in several groups, and to a packaging process and machine, especially for producing a packaging container, incorporating such an apparatus.

There are known packaging machines and installations which use stacked cardboard blanks and which possess apparatuses for the unit storage and distribution of the blanks, of the type comprising a magazine in which the blanks are stored stacked, transfer means, such as movable grippers or suction cups associated with the magazine, and a conveyor means forming part of the machine or installation (documents FR-1,361,604, FR-2,458,493, FR-2,469,353, US-3,356,976 and US-3,996,843).

Because of the inherent complexity of most packaging machines and installations known in the trade at the present time, the problem of automating the adjustment of the feed of the stacked blanks according to their format has not been posed seriously or solved hitherto. Moreover, the magazines have a limited blank capacity.

In fact, most of these packaging machines are installations are of the type intended for a single blank format, and any change in the blank format is made by means of lengthy and complicated adjustment of the machines and installations and manual substitution of the blanks.

The prospect of packaging machines and installations with automatically adjustable format therefore means that this manual substitution of the magazines is no longer appropriate. Moreover, the use of high-speed machines and installations can be restricted by the limited capacity of the magazine and the standstill times necessary for filling it.

The document US-3,137,981 describes a packaging machine having several blank magazines. This plurality of magazines forms an assembly which is mounted movably relative to single-station transfer means (extraction suckers) by means of driving jacks, in such a way that the magazine to be used is placed vertically in line with the transfer means. The formats of the blanks of the various magazines are identical, the only difference between the blanks of the various magazines being their visual appearance. The packaging machine is therefore of the single-format type and is not continuously adjustable. The assembly comprising the plurality of magazines and their driving jacks constitutes an accessory forming a functional entity which can be added to any packaging machine of the type in question, upstream, at the location of the transfer means. However, the packaging machine according to the document US-3,137,981 does not make it possible to change the blank format; it is not suitable for a large number of magazines; its performances are limited because of the need to shift the magazines and the blanks which they contain, thus preventing, in particular, the possibility of changing a magazine at each cycle; it makes it difficult, if not impossible, to feed the magazines themselves automatically because of their variable position.

The document US-1,625,057 describes a cardboard-blank feed apparatus comprising four identical magazines which are carried by a table driven in rotation about its axis by quarter-turn drive means, the magazines themselves being arranged at right angles round this axis. The magazine to be used is brought by the drive means into a feed position, in which the blanks can be extracted. Once this magazine has been emptied, the table is pivoted a quarter turn in order to bring the following magazine into the feed position. The magazine previously emptied can then be filled. This apparatus has the same disadvantages as those mentioned above in relation to the document US-3,137,981.

The document US-3,952,636 describes a machine for shaping boxes stored flat in one or more magazines, more specifically stored vertically, the feed of flat boxes taking place simultaneously for the plurality of magazines. This machine comprises a pair of magazines which are located at a distance from one another and the orifices of which face one another, a pair of suction cups which are opposite one another and face the orifices of the magazines and which are driven slideably in the horizontal direction, and two blank-guide chutes arranged between and underneath the orifices of the magazines and suction cups. The object or effect of this machine is not a change in the format of the blanks used, such a change of format being impossible. Not only is there no provision for the possibility of changing the format in the time allowed, but there is also no provision for ensuring that the two magazines can contain blanks of different formats. Because of its very design, this machine can take only two magazines at most, but no more. This machine is designed specifically for magazines with vertical blanks, with all the consequences arising from this, in particular the need for pushers to advance the blanks in the magazines in proportion as they are extracted, the impossibility of automatic loading of the magazines as a result of gravity alone, limitations on the very use, particularly the filling, of the boxes. In fact, the machine according to the document US-3,952,636 is, as a whole, a double machine, the two parts of the machine being placed next to one another and operating in synchronism.

The document US-4,192,496 describes an apparatus for transferring stacks of sheets. However, this apparatus is not suitable for the unit distribution of blanks in packaging machines, with the possibility of a change of format.

The object of the invention is, therefore, to solve the first problem of increasing the performances in the unit distribution of blanks from several separate groups of blanks. The invention also aims, at the same time, to solve the second problem of increasing the performances of packaging machines and installations with several blank magazines. Finally, the invention aims to solve this second problem in the particular case of a packaging machine which can operate with several different blank formats.

More specifically, the object of the invention is to allow the presence of any number, including a large number, of magazines or groups of blanks, a change of operational magazine without a substantial period of standstill of the machine using the blanks, and the possibility of filling the magazines with the blanks automatically as a result of gravity alone.

To achieve this, the invention first provides a process for the horizontal unit distribution of blanks stored horizontally in a plurality of vertical stacks forming the same plurality of uniform groups of blanks in the same plurality of magazines placed next to one another and having lower extraction orifices, by movable transfer means and a first conveyor means, in which process the magazines are first filled with the blanks, an operational magazine, from which a blank is to be extracted, is subsequently selected from the plurality of magazines, and finally the transfer means associated functionally with the operational magazine are actuated so as to extract the lowest blank from the operational magazine and bring it to the first conveyor means for its subsequent distribution. According to the invention, the relative overall position of the magazines and of the first conveyor means is maintained fixed, also between two successive different selections, from a plurality of transfer means associated structurally and functionally with the plurality of magazines respectively are selected those and only those associated with the selected operational magazine, and only the selected transfer means are actuated.

The invention then provides a process for packaging contents in containers which puts into practice this blank distribution process, the containers being produced from these blanks.

The invention also provides an apparatus for the horizontal unit distribution of blanks stored horizontally in a plurality of vertical stacks forming the same plurality of uniform groups of blanks, of the type comprising a plurality of magazines placed next to and aligned with one another and having lower extraction orifices and intended for receiving the same plurality of stacks of blanks, a first blank conveyor means for their horizontal unit distribution, means for selecting an operational magazine from the plurality of magazines, and movable transfer means, such as grippers or suction cups or the equivalent, shifted by drive means and designed to be associated functionally and structurally with the operational magazine, so as to grasp the lowest blank of the operational magazine in order to extract it from this operational magazine and bring it to the first conveyor means. According to the invention, the first conveyor means is of the linear-drive type, the magazines and the first conveyor means are in a fixed overall relative position, the magazines are arranged vertically above the first conveyor means, the transfer means are designed in the form of a plurality of transfer means associated structurally and functionally with the same plurality of magazines respectively, and the apparatus possesses means for selecting the operational transfer means associated with the selected operational magazine, which are such that the drive means shift only the selected transfer means.

Finally, the invention provides an installation for the packaging of contents in containers which incorporates such an apparatus for the distribution of blanks serving to produce the containers.

As already emerges from the foregoing and as is explained in detail later, the blank magazines remain stationary, even during a change of magazine. This makes it possible, on the one hand, to avoid the need to provide complex means for supporting and shifting the magazines and, on the other hand, to avoid the standstill times which the shifting of the magazines requires. Furthermore, it is possible to provide any number of magazines, including a large number, for example of the order of two to ten, without any appreciable increase in the complexity of the apparatus or any substantial reduction in the work rates. Because of the modular structure of the apparatus, it is also possible to change the number of magazines even once the apparatus is installed. The arrangement of vertical stacks of blanks remaining permanently stationary allows loading from above as a result of gravity, particularly by automated means, such as robots, and extraction from below, the stack adjusting itself as a result of gravity in proportion to loading and extraction. Where a packaging machine using single-format blanks is concerned, the invention makes it possible to obtain an increase in the work rate, since the magazine change can be made instantaneously, without the machine stopping or slowing, whilst the unused magazine can be filled automatically, as a result of gravity alone, because it is at a specific constant location. As regards a packaging machine using blanks of different formats, the invention likewise makes it possible to obtain a very substantial increase in the work rate, together with an increase in the versatility of use, since there can be a larger number of formats.

The process and apparatus according to the invention are intended more particularly, but not exclusively, for packaging, especially packaging machines and installations preferably of the multi-format type, in which case the groups of blanks differ at least partially from one another, and/or alternatively of the high-speed type, in which case the groups of blanks are similar. The process and apparatus according to the invention are especially efficient when the multi-format packaging machine and installation are automatic, because the automation of the adjustment of the machine or installation is not disrupted by the adjustment of the blank feed. In all cases, the change of magazine is made instantaneously. The invention will be understood clearly from the following description, with reference to the drawings in which:

Figure 1:
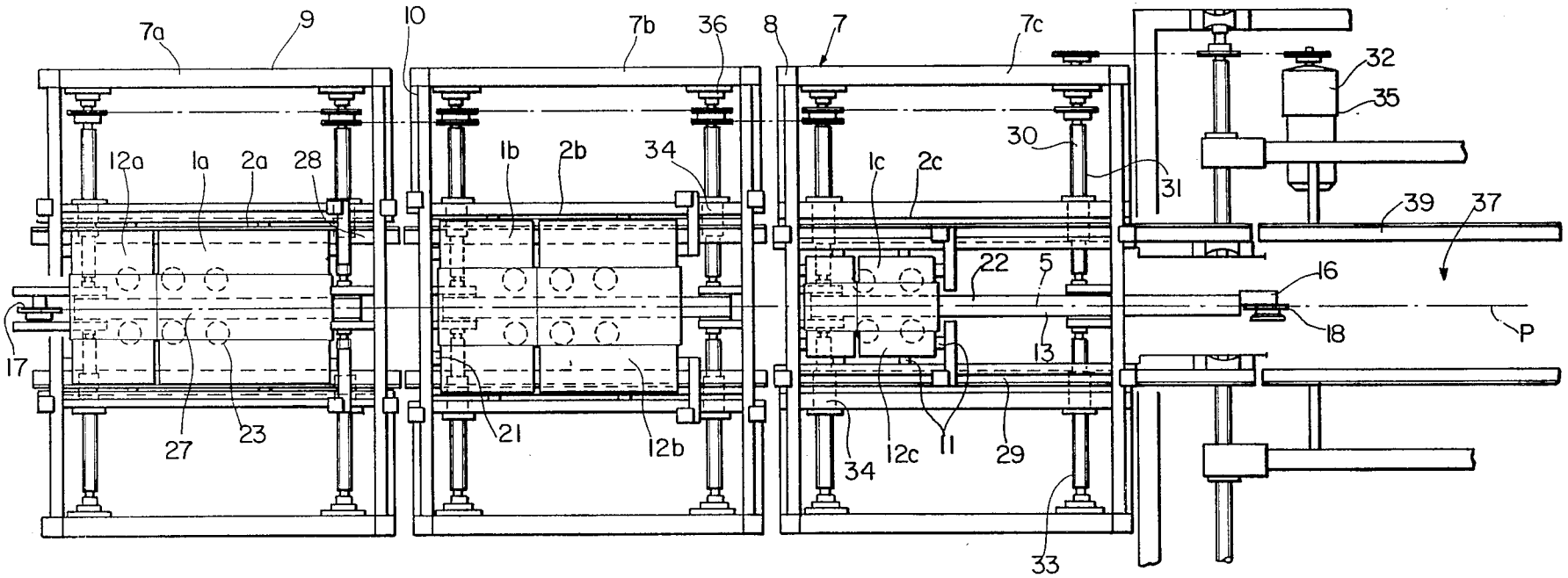
FIG. 1 is a diagrammatic plan view of a distribution apparatus according to the invention, associated with a packaging machine shown partially.
Figure 2:
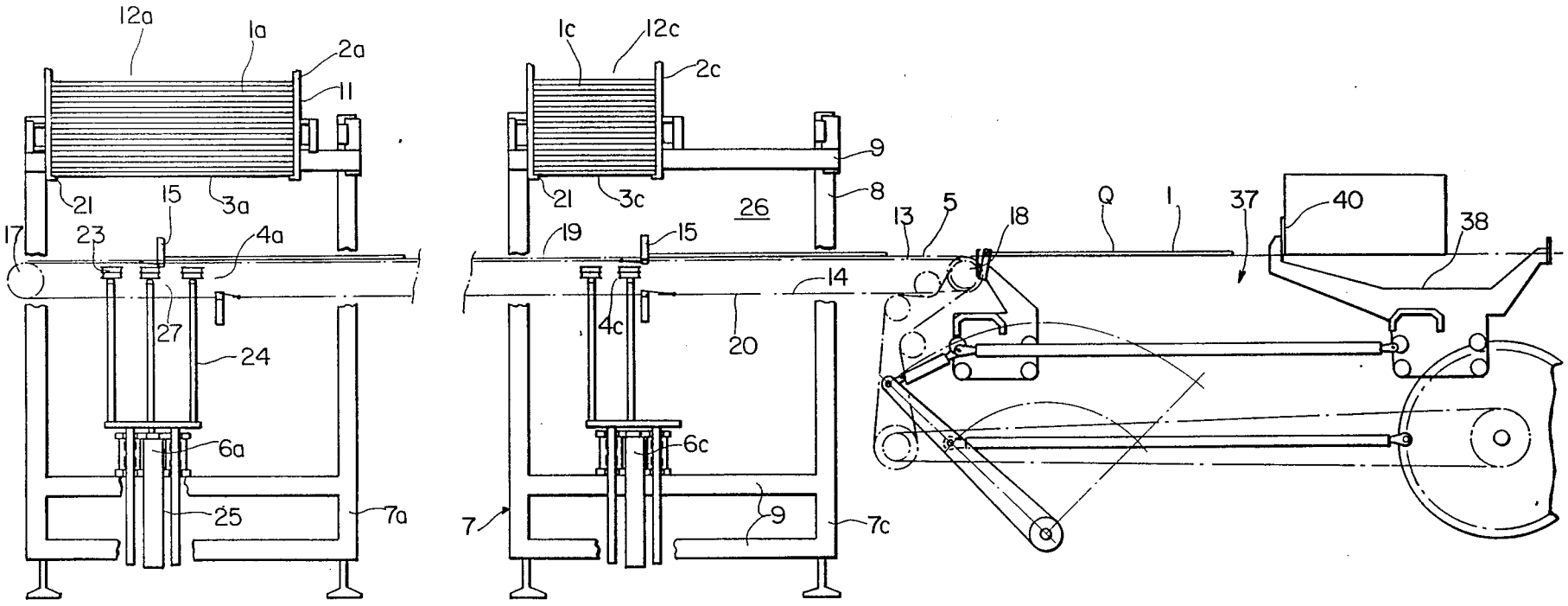
FIG. 2 is a partial vertical elevation view of the apparatus of FIG. 1, associated with a packaging machine. The invention is concerned first with a process and an apparatus for the horizontal unit distribution of blanks 1*a*, 1*b*, 1*c* etc., intended more particularly for packaging.

The blanks are either flat, joined together or take another form. They are stored horizontally in a plurality of vertical stacks, forming the same plurality of uniform groups of blanks (the blanks of one and the same stack being similar). The references 1*a*, 1*b*, 1*c*, etc., denote both the blanks of the various stacks and the blank stacks themselves or the corresponding groups of blanks.

The invention also relates to a packaging process and installation putting into practice the distribution process and apparatus, the blanks then being intended to form containers, such as boxes, cases, crates or the like, surrounding the contents (such as a case, bottle, packet or the like) in order to package them.

The groups of blanks are stored in the same plurality of magazines 2*a*, 2*b*, 2*c*, etc., placed next to one another, in particular aligned and in horizontal succession near to one another, and having respective lower extraction orifices 3*a*, 3*b*, 3*c*, etc.

The process and apparatus for the distribution of the blanks also make use of and possess respectively, first, movable transfer means 4 and, then, a first conveyor means 5 likewise movable, in order to transport the distributed blanks from the magazines, from which they are extracted, to their subsequent destination.

According to the process, the magazines 2*a*, 2*b*, 2*c*, etc., are first filled with the blanks 1*a*, 1*b*, 1*c*, etc., respectively; subsequently one and only one operational magazine 2, from which a blank 1 is then to be extracted, is selected from the plurality of magazines 2*a*, 2b, 2c, etc; finally, transfer means 4 associated functionally with the operational magazine 2 are actuated, so as to extract the lowest operational blank 1 from the operational magazine 2 and bring it to the first conveyor means 5, which is in movement, for its subsequent distribution to the packaging machine in particular.

According to the invention, the overall relative position of the magazines 2a, 2b, 2c, etc., and of the first conveyor means 5 is maintained fixed, also between two successive different selections. Selected from a plurality of transfer means 4a, 4b, 4c, etc., associated structurally and functionally with the same plurality of magazines 2a, 2b, 2c, etc., respectively are those and only those associated with the one operational magazine 2 selected. And only the selected transfer means 4 are actuated.

By "maintaining the overall relative position of the magazines and of the first conveyor means fixed" is meant that the locations of these remain in a fixed relative position, although this does not prevent one or more either localized or general shifts, but without a change of location. Thus, the magazines 2" can have an individually changeable configuration so as to be matched to the blanks 1", and the first conveyor means 5 (more specifically its drive member) is movable in order to perform its transport function.

In a first alternative version (illustrated in the Figures), the groups of blanks 1a, 1b, 1c, etc., are of different types (particularly in terms of dimensions) from one another either completely or partially, and the invention is intended more especially to allow a change in the type of blank, particularly in the format. In a second alternative version (not shown), the groups of blanks 1a, 1b, 1c, etc., are identical, and the aim of the invention is to increase the total storage capacity for the blanks 1a, 1b, 1c, etc., and avoid the dead time involved in loading an empty magazine or passing from one magazine to another.

The blank 1, once on the first conveyor means 5, is used, manipulated, shaped, treated, etc., for its final purpose or intended use, particularly packaging.

The number of blank magazines 2a, 2b, 2c, etc., is determined by the number of uniform groups of blanks 1a, 1b, 1c, etc., to be used for packaging or any other use for which the invention is intended. This whole number can be small, for example two or three, or on the contrary large, for example of the order of 10 or even more.

Preferably, the blanks 1a, 1b, 1c, etc., are flat cardboards of one or more thicknesses, intended to be folded, extended, shaped or the like in order to form a container forming a pack. However, the invention can have other uses, and the blanks can be sheets, particularly in office machines (for example, photocopiers), or pieces, such as metal sheets, in industrial processes.

In the text, the references 1a, 1b, 1c, etc., denote the blanks located in the respective magazines 2a, 2b, 2c, etc., the selected and therefore operational magazine bearing the reference 2 and the blanks of this selected and operational magazine the reference 1', and the operational magazine 2 being one of the magazines 2a, 2b, 2c, etc., and the blanks 1 being from the blanks 1a, 1b, 1c, etc., respectively. That blank to be used, namely the lowest blank of the stack of blanks 1', that is to say the operational blank, is designated by 1, the other upper blanks 1' being on stand-by for subsequent use without any other change of selection. The indices a, b, c, etc., associated with a reference denoting a member, a means, etc., refer to this member, means, etc., in as much as it is associated with the magazine 2a, 2b, 2c, etc., bearing the same index (or with the corresponding blank 1a, 1b, 1c, etc.). This same member, means, etc., with its reference without an index a, b, c, etc., denotes the selected or operational member, means, etc. Finally, 1", 2", etc., denote respectively a blank, a magazine, etc., in general, whether operational or not, this being for reasons of simplification.

By the selection of a member, means, etc., so that it becomes operational is meant that from a plurality of similar such members, means, etc., one only (which itself can be multiple) is selected to be used or put into practice, whilst the others are not intended to be used at that moment.

The various magazines 2" are equipped and filled with corresponding blanks 1", grouped according to uniform formats, either manually or in a mechanized fashion, on demand or in a programmed manner, by units or not, etc. By format is meant a particular type and/or a particular form and/or particular dimensions of a blank. Stored in each magazine 2" is the number of similar blanks 1" suitable for allowing effective, especially sufficiently long-lasting operation of the apparatus according to the invention. According to the invention, the magazines 2" operate by gravity alone, because of the vertical arrangement of the stacks of blanks 1".

The operational magazine 2 is selected particularly according to the operating program of the machine or installation especially a machine or installation intended for packaging, with which the distribution apparatus is associated and for which corresponding blanks 1 are intended. This operating program of the machine or installation is determined either manually or automatically. It can consist of one or more recorded programs or of an appropriate response to a suitable request, taking into account the detection of a causative fact, such as, for example, the type and format of the content to be packaged. This selection is made either for each successive blank 1 or, preferably, for a certain number of identical successive blanks 1, bearing in mind the conventional organization of such a machine or installation working in uniform series.

However, the automatic nature, instantaneous and without any special movement of a component, member, etc., of the change of groups of blanks and therefore the simplicity and rapidity arising from this allow changes of groups of blanks 1 as many times as necessary, if appropriate even for each blank 1, without appreciably affecting the work rate and output of the machine or installation with which the distribution apparatus according to the invention is associated. Where several groups of similar blanks 1" are concerned, the invention allows a magazine 2" to be changed quickly, and the unused magazine 2" can then be filled with blanks 1" once again.

By transfer means 4, a blank 1 is transferred from the operational magazine 2 to the first conveyor means 5 by grasping this blank 1 positively, especially mechanically by gripping or pneumatically by vacuum suction. Any other method making it possible to transfer a blank 1 from the operational magazine 2 to the first conveyor means 5 can be used if it is suitable for the apparatus. In general, the blank 1 is grasped on its free lower face located in the lower orifice 3.

In a particular use of the invention, the different blanks 1a, 1b, 1c, etc., have different overall sizes in the transverse (and horizontal) direction in relation to their general common direction of advance in the distribution apparatus along the first conveyor means 5 and in the associated machine or installation, the latter direction being called the longitudinal direction (and normally being horizontal). In this case, the effective transverse overall size of the first conveyor means 5 is adjusted in dimensional terms in response to the selection of the magazine 2, before the transfer means 4 is actuated, so that the first conveyor means 5 is matched dimensionally and transversely to the blanks 1 and to the corresponding transverse dimension of the operational magazine 2 selected. By the effective overall size of the first conveyor means 5 is meant the overall size allowing this first conveyor means 5 to be active and suitable in dimensional terms for transporting the blanks 1 effectively. In this case, the first conveyor means 5 is dimensionally adjustable in the transverse direction and lockable in any position, once adjusted. Moreover, the mode of operation of the apparatus is such that, at any moment, all the blanks 1 located on the first conveyor means 5, if there are several blanks, are identical in the transverse direction at least.

In a first alternative version of the process, a plurality of magazines 2'' identical to one another is filled with a plurality of uniform groups of blanks 1'' of formats identical to one another. In a second alternative version, a plurality of magazines 2'' of sizes different from one another in the longitudinal direction and/or in the transverse direction is filled with a plurality of uniform groups of blanks 1'' of formats different from one another. These two alternative versions can be combined, in which case the distribution apparatus contains several groups of blanks 1'' of different formats and, for at least one particular format, several separate groups of blanks 1''.

The invention thereafter relates to a process for packaging contents in containers consisting of boxes, cases or crates produced from blanks, in which process blanks 1'' stored horizontally in a plurality of vertical stacks forming the same plurality of uniform groups of blanks 1'' are first distributed horizontally and by units, a container is subsequently formed from the operational blank 1 distributed, and a content is surrounded by this container. According to this packaging process, the blanks 1 are distributed by means of the process described above. If the groups of blanks 1'' are identical, the effect of putting this distribution process into practice is to allow continuous packaging, without the need for standstill times attributable to the filling of the magazines 2'' with the blanks 1''. If the groups of blanks 1'' are different from one another, the effect of putting this distribution process into practice is to allow continuous packaging with containers of different dimensions or characteristics (form, marking, etc.), without the need for standstill times attributable to the change of format of the blanks. The packaging process per se does not directly form the subject of this invention and it is therefore not described in any more detail. It can, per se, form the subject of various alternative embodiments.

The invention also relates to an apparatus for the horizontal unit distribution of blanks stored horizontally in a plurality of vertical stacks forming the same plurality of uniform groups of blanks intended more particularly for a packaging machine, and putting into practice the process which has just been described.

This apparatus is of the type comprising a plurality of magazines 2'' placed horizontally next to one another and aligned longitudinally, having horizontal lower extraction orifices 3'' and intended for receiving the same plurality of stacks of blanks 1'', a first movable conveyor means 5 for conveying the blanks 1, in order to distribute them horizontally and by units, means for selecting an operational magazine 2 from the plurality of magazines 2'', and movable transfer means 4, such as grippers or suction cups or the equivalent, shifted by drive means 6'' and designed to be associated functionally and structurally with the operational magazine 2, so as to grasp the lower operational blank 1 of the operational magazine 2 in order to extract it from the operational magazine 2 and bring it to the first conveyor means 5, on which it is conveyed to its subsequent station of use.

This apparatus is such that the first conveyor means 5 is of the linear-drive type, the magazines 2'' and the first conveyor means 5 are in a fixed overall relative position, the transfer means 4 are designed in the form of a plurality of transfer means 4'' associated structurally and functionally with the same plurality of magazines 2'' respectively, and the apparatus possesses means for selecting the operational transfer means 4 associated with the selected operational magazine 2, which are such that the drive means 6'' shift only the selected transfer means. By linear-drive conveyor means is meant a sliding stud-type conveyor or equivalent, in contrast to a conveyor of the turntable type. This first conveyor means 5 is also of the perforated type, allowing passage through it. Such a first conveyor means 5 is known per se, for example in the packaging sector.

This apparatus has a frame 7 in one or more parts, resting on a bearing plane, in particular usually a horizontal floor. It is in relation to a horizontal bearing plane that reference is made in the text to such an orientation. The frame 7 comprises component elements 8 extending in the vertical direction, particularly on the periphery of the apparatus, particularly top and bottom horizontal and longitudinal component elements 9, and particularly top and bottom horizontal and transverse component elements 10, the adjectives "longitudinal" and "transverse" having been defined above respectively as the general direction of advance of the blanks and the direction perpendicular to the latter and horizontal. Preferably, the frame 7 has a modular structure, being composed of separate blocks *7a, 7b, 7c,* etc., each for a magazine *2a, 2b, 2c,* etc.

The blank distribution apparatus generally has a longitudinal and vertical plane of symmetry P.

The magazines 2'' do not in themselves, taken individually, form the subject of the invention and are known to or within the scope of an average person skilled in the art, in other uses. Consequently, the magazines 2'' are not described in any more detail. Such magazines are carried fixedly by a frame 7, have vertical and lateral and longitudinal and transverse cheeks 11'' mounted so as to be adjustable in terms of their spacing and lockable on the frame 7, possess horizontal upper loading orifices 12'' of likewise fixed position, and are aligned along and above the first conveyor means 5.

The cheeks 11'' hold between them a stack of blanks 1'', being matched to this without thereby preventing the successive unit removal of the lowest operational blank 1 of the stack in conformity with requirements. The magazines 2'' are shaped to receive the corresponding blanks 1''. In particular, the different magazines 2'' are obtained simply as a result of the dimensional adjustment of the same single type of adjustable magazine 2'' having lateral cheeks 11'' adjustable particularly by longitudinal and/or transverse sliding and lockable in position. This adjustment itself can be manual or automatic or servo-controlled.

By the fact that a single magazine 2 is operational is meant that, at a particular moment, if a magazine is used when the machine or installation is in operation, there is only a single magazine 2 which can be used and not several magazines 2" simultaneously.

Either the magazines 2" of the plurality of magazines are identical and are intended for blanks of identical formats or they are different, particularly of different sizes, and are intended for blanks of different formats or, finally, there is a combination of these two circumstances.

The magazines 2" are normally arranged in one and the same upper horizontal plane of the apparatus, in the top part of the frame 7.

The first conveyor means 5 comprises first movable means 13 for the longitudinal sliding drive of the operational blanks 1, which consist of at least one flexible connection of the endless, non-extendable, filamentary type 14, extending in a unitary manner opposite the plurality of extraction orifices 3" of the plurality of magazines 2" and supporting at least one stud 15 for driving a blank 1, this first means for longitudinal sliding drive 13 being located at a transverse distance from the transfer means 4" in the extraction position and being driven by a drive member, such as a motor 16. The connection 14 is, for example, an endless chain or equivalent stretched between two end pinions 17, 18 with horizontal and transverse axes, which are carried by the frame 7 and which are located at the two upstream and downstream longitudinal ends of the apparatus in relation to the direction of advance of the blanks 1. Such a connection 14 comprises an active upper strand 19 and a lower inactive return strand 20. Preferably, there are several studs 15 arranged at a uniform distance from one another. In this case, at the moment of a particular selection of an operational magazine 2, one of the studs 15, namely that located under the operational magazine 2, is activated purely as a result of this position. The studs 15 are mounted on the connection 14 so as to project vertically upwards from the upper strand 19. Preferably, the upstream transverse edges 21" of the extraction orifices 3" of the magazines 2" and the studs 15 of the first conveyor means 5 are respectively arranged at the same uniform distance from one another.

By the first conveyor means 5 extending in a unitary manner under the magazines 2" is meant that it is the same single first conveyor 5 having the structure described which extends under the plurality of magazines 2".

The first conveyor means 5 can function preferably continuously or, on the contrary, intermittently in a cycle.

Preferably, a connection 14 of the first conveyor means 5 is carried by a fixed longitudinal beam 22 carried by the frame 7 and set transversely apart from the transfer means 4 so as not to interfere with these, and also supporting the drive member 16.

The connection 14 and the beam 22 can, for example, be arranged in the longitudinal mid-plane P. However, the connection 14 and the beam 22 can also be set apart from the plane P, provided that they do not interfere with the transfer means 4 during the movement of the latter.

The connection 14 and the beam 22 are arranged substantially at the mid-height of the frame 7 vertically in line with and underneath the magazines 2".

The transfer means 4 located towards the lower half of the frame 7 comprise, for each of those of the plurality, at least one transfer member 23", such as a vacuum-suction gripping sucker or equivalent, each carried by a vertical drive rod 24" of a length at least equal to the distance between the first conveyor means 5 and the lower extraction orifice 3" and extending and being directed from the member 23" in the opposite direction to the magazine 2" in relation to the first conveyor means 5, means 25" for driving the rod 24" and therefore the member 23" and therefore the transfer means 4" between two end positions, namely, on the one hand, a lower position in which the transfer member 23" is adjacent to the first conveyor means 5 either for the distribution of a blank 1 to this first conveyor means 5 or for inactive resting and, on the other hand, an upper extraction position in which it is adjacent to the extraction orifice 3", and means for operating the transfer member 23", such as vacuum feed means for the suction cup. The means for selecting the transfer means 4 act on the means 25" for driving the rods 24" and on means for operating the transfer member 23". A free horizontal and longitudinal passage 26 is formed above the first conveyor means 5 when the members 23" are in the lower position, in order to allow the unobstructed passage of blanks 1, also underneath a non-operational magazine 2" from which this blank is not extracted and which is located downstream of the operational magazine 2.

The suction cups 23" can be replaced by any member of a different, but functionally equivalent type or structure, intended to ensure the grasping, shifting and distribution of blanks. The vacuum feed means are then replaced by any other different means suitable for this member. For example, the transfer member can be gripping tongs and the operating means can then be joints, jacks, etc., designed to cause the tongs to function.

The means 25" for driving the rods 24" comprise, for example, pneumatic jacks located in the lower part of the frame 7.

The vacuum feed means comprise, for example, a vacuum source, conduits connecting this source and the suction cups 23" and valves designed to cut off the vacuum feeding. Such feed means are known per se to a person skilled in the art for other uses and are therefore not described in any more detail. The same is true of pneumatic jacks or an equivalent member for driving the means 25" of driving the rods 24".

The means for selecting the transfer means 4" can be associated with the means for selecting the magazines 2" and can act on the vacuum-feed valves.

Preferably, for one and the same magazine 2", there are several transfer members 23", such as suction cups or the equivalent, and several associated drive rods 24" arranged at a longitudinal and/or transverse distance from one another and forming between them particularly a longitudinal space 27 for the passage of the first movable means for longitudinal sliding drive 13 and of the longitudinal beam 22 carrying the first conveyor means 5.

This space 27 is essentially effective horizontally and transversely in line with the first conveyor means 5.

On the contrary, the transfer members, such as suction cups 23" or the equivalent, are arranged, for example, in the central part of a magazine 2" (as seen in a horizontal plane). For the different magazines 2", the members 23" associated with each of them preferably have the same component configuration, whatever the component configuration of the magazines 2", thus making it possible to standardize the transfer means 4", these being of a number equal to and as large as that of the magazines 2" and being identical to one another. For example, there are two longitudinal rows of suction cups 23" facing one another on either side of the plane P and symmetrically, each row comprising several suction cups 23" (three in the example shown, although the number is not limiting). For example, the two rows of suction cups 23" are arranged on either side of and in direct proximity to the first conveyor means 5 and the beam 22.

The first conveyor means 5 also possesses first lateral means 28 for the longitudinal guidance of the operational blanks 1, which consist of two lateral slides 29 extending longitudinally. The slides 29 are normally symmetrical with one another in relation to the plane P and are arranged at least substantially in the horizontal plane of the upper strand 19 which thus forms a horizontal plane Q for the longitudinal sliding of the blanks 1. Each slide 29, in cross-section and in vertical section, can have the general form of an angle piece having a horizontal wing which faces the plane P and on which the longitudinal free end transverse part of the blank 1 slides, being supported by it, and a vertical wing which is directed upwards and along which the corresponding free edge of the blank 1 slides, being guided by it. For this purpose, the transverse spacing between the two slides 29 (particularly their vertical wings) corresponds to the transverse spacing between the longitudinal edges of the operational blank 1, that is to say to its transverse overall size.

A slide 29 can be continuous or discontinuous. It can either be single and common to the plurality of magazines 2" and then extend in one piece along and next to the longitudinal beam 22 or also comprise a plurality of longitudinal portions of a number equal to that of the plurality of magazines 2", each portion being associated structurally and functionally with one of the magazines 2". The various slide portions 29 are in the longitudinal extension one of the other, the distance between two adjacent portions being zero or very small in order to allow continuity in the holding and guidance of the blanks 1. This embodiment is particularly suitable for a modular frame 7 composed of blocks 7", as mentioned.

The lateral slides 29 are carried by carrying means 30 ensuring their adjustable and lockable transverse spacing, these carrying means 30 being controlled by the means for selecting an operational magazine 2 or the operational transfer means 4, so that the transverse spacing of the lateral slides 29 is equal to or matches the transverse format of the blanks 1' of the selected operational magazine 2. The carrying means 30 are themselves carried by the frame 7. These carrying means 30 are either single and common to all the magazines 2", particularly when a frame 7 is itself in one piece, or in several parts, each for a magazine 2" and a block 7" of the frame 7. In the latter case, the various component parts of the carrying means 20 are associated with one another, particularly in order to ensure synchronous movement of the various slide portions 29 from common and single drive means.

The carrying means 30 of the lateral slides 29 comprise means 31 for guiding the lateral slides 29 in the transverse direction and means 32 for driving the lateral slides 29 along the guide means 31, with locking in position, especially in opposite directions for the two slides 29 arranged on either side of the plane P.

In a possible, but not exclusive embodiment, the carrying means 30 comprise transverse threaded shafts 33 which are carried by the frame 7 and on which the lateral slides 29 are mounted via internally threaded holes 34, and a drive motor 35 for the threaded shafts 33 which is controlled by the selection means. The threaded shafts 33 are arranged underneath the sliding plane Q of the blanks 1. For example, the shafts 33 are each in two coaxial parts on one side of the plane P and the other and are carried by bearings 36, on the one hand internal and fastened to the longitudinal beam 22 and on the other hand external and fastened to the frame 7 laterally. Preferably, where carrying means 30 in several parts for each magazine 2" are concerned, these means 30, especially the shafts 33, are located at the two upstream and downstream ends of each block 7" of the frame 7 corresponding to each magazine 2".

With regard to the alternative version with threaded shafts 33, the threads of the two coaxial parts of the shafts 33 are directed opposite to one another. Such shafts 33 in themselves constitute guide means 31. Their thread, the internally threaded holes 34 and the motor 35 form the drive means 32.

The means for selecting the operational magazine 2 and the means for selecting the operational transfer means 4 likewise acting on the first lateral means of longitudinal guidance 28 are controlled by means for selecting a group of blanks which are manual or automatic according to an operating program or in response to the requirement of a packaging machine 37 in particular, with which the apparatus is associated.

As emerges from the foregoing description, the magazines 2" are essentially static and, per se, passive both individually and as a whole. Moreover, as a result of the design of the apparatus, as described, each magazine 2" can be made operational simply because the transfer means 4" associated with it are made operational. Thus, the distribution apparatus functions, is adjusted and becomes operational, for such and such a magazine 2 selected, on the basis of an input command for the use of such and such a blank 1, this command acting directly, on the one hand, on the first lateral means of longitudinal guidance 28, to adjust them transversely and match them to the blank to be distributed, and, on the other hand, on the transfer means 4", in such a way that only those blanks of the blank stack, of which a blank 1 is to be distributed, are made operational, the result of this being first the actuation of the operational driVe means 25 and second that of the operating means of the operational transfer member or members 23.

The selection means are known per se or are within the scope of a person skilled in the art. They function in response to an input command usually in the form of an electrical signal and incorporate the appropriate automatic mechanisms, circuits, programs, etc.

The apparatus which has just been described operates as follows, when it has suction cups as transfer members 23": initially, the magazines 2" are filled with the blanks 1" corresponding to the appropriate magazines 2". The transfer means 4", of a number equal to that of the magazines 2", are in the lower position (as shown). The drive means 6 are actuated, the studs 15 sliding at a constant linear speed along the upper strand 19 from upstream in the downstream direction in the plane P. A command is sent to the distribution apparatus and therefore to the selection means. This command entails distributing one or more blanks 1 of such and such a group of blanks, that is to say coming from such and such an operational magazine 2. The transfer means 4″ of the non-operational magazine or magazines 2″ remain inactive and in the retracted lower position, and the transfer members 23″ forming them are neither shifted nor made operational. The means 4 for transferring the operational magazine 2 are actuated by the drive means 25 and the vacuum-generating means, so that the corresponding suction cups 23 execute a to-and-fro movement vertically upwards and then vertically downwards from and to their lower position, at the same time grasping the lowest operational blank 1 from the operational magazine 2 and bringing it downwards to the first conveyor 5, these cinematics being combined with the movement of one of the studs 15, so that the latter then drives the blank along the first conveyor means 5 as a result of the first guide means 31. Previously, as a result of the selection made, the relative position of the lateral slides 29 has been adjusted in terms of their mutual transverse spacing, so that they can receive the extracted blank 1. According to the position of the operational magazine 2 (from upstream in the downstream direction), the moving operational blank 1 can, if appropriate, pass under one or more non-operational magazines 2″ without being impeded, the passage 26 being free of any obstacle. The extracted operational blank 1 is delivered, and another cycle for a blank of the same format or of a different format can begin. If a blank of a different transverse format is activated in the process, activation occurs only when the previously extracted blank, moving on the first conveyor means, has left the latter so that this can then be adjusted in the transverse direction without obstruction.

The invention also relates to a packaging installation which possesses a packaging machine comprising an apparatus for constructing containers from distributed blanks and for surrounding contents with the containers, possessing a second means 38 for conveying the blanks and/or the containers respectively which consists of second longitudinal drive means 39 and second lateral means of longitudinal guidance 40, and an apparatus for the unit distribution of the blanks, as just described. This apparatus is located upstream of the packaging machine 37, the first and second conveyor means 5, 38 being in the longitudinal extension one of the other and in direct proximity to one another, and the spacing between the first and second lateral means of longitudinal guidance 28, 40 being identical.

Preferably, the second lateral means of longitudinal guidance 40 likewise have an adjustable transverse spacing. In particular, they are driven by the same motor 35 as that driving the first lateral guide means 28.

Likewise, the apparatus for distributing the blanks preferably possesses means for retracting the studs 15 at the downstream end of the first means for longitudinal sliding drive 13, at the location where these are adjacent to the second longitudinal drive means 39. These retracting means comprise, for example, a projection with which an extension of the studs 15 interferes.

I claim:

1. A process for packaging contents in containers comprising boxes, cases, or crates produced from blanks, the blanks being stored horizontally in groups in a plurality of vertical stacks in a corresponding plurality of magazines, the magazines being placed next to one another and having lower extraction orifices from which the lowest blank in the stack is discharged, each magazine having a corresponding transfer means structurally and functionally associated therewith, the transfer means being movable up and down, and the magazines being maintained in an overall, fixed position above a conveyor means between two successive, different selections, the conveyor means moving continuously in one direction, said process comprising the steps of:

(a) filling the plurality of magazines with the blanks;
(b) following step (a), selecting from the plurality of magazines an operational magazine from which a blank is to be extracted and selecting only the transfer means associated with the operational magazine;
(c) following step (b), actuating only the selected transfer means, and using the selected transfer means, extracting the lowest blank from the lower extraction orifice of the operational magazine and moving the extracted blank downwardly to the conveyor means for its subsequent distribution;
(d) following step (c), moving the extracted blank continuously in one direction using the conveyor means, to distribute the extracted blank;
(e) following step (d), forming a container from the distributed blank; and
(f) following step (e), placing the contents in the container, whereby continuous packaging of the contents in containers is effected without standstill times attributable to filling the magazines with blanks.

2. The process of claim 1, wherein a plurality of magazines of different sizes is filled with a plurality of uniform groups of blanks of different formats, whereby continuous packaging of the contents in containers of different dimensions is effected without standstill times attributable to changing the format of the blanks.

3. A process for the horizontal unit distribution of package blanks by a plurality of movable transfer means and conveyor means, the transfer means being movable up and down, the blanks being stored horizontally in groups in a plurality of vertical stacks in a corresponding plurality of magazines, the magazines being placed next to one another and having lower extraction orifices from which the lowest blank in the stack is discharged, each magazine having a corresponding transfer means structurally and functionally associated therewith, and the magazines being maintained in an overall, relative fixed position above the conveyor means, said process comprising the steps of:

(a) filling the plurality of magazines with the blanks;
(b) following step (a), selecting from the plurality of magazines an operational magazine from which a blank is to be extracted and selected only the transfer means associated with the operational magazine; and
(c) following step (b), actuating only the selected transfer means, and using the selected transfer means, extracting the lowest blank from the lower extraction orifice of the operational magazine and moving the extracted blank downwardly to the conveyor means for its subsequent distribution.

4. The process of claim 3, wherein a plurality of identical magazines is filled with a plurality of uniform groups of blanks of identical format.

5. The process of claim 3, wherein a plurality of magazines of different sizes is filled with a plurality of uniform groups of blanks of different formats.

6. Apparatus for the horizontal unit distribution of package blanks stored horizontally in groups in a plurality of vertical stacks, comprising:

a plurality of magazines arranged next to and aligned with one another and adapted to receive the plurality of stacks of blanks, each of said magazines having a lower extraction orifice;

linear, continuous conveyor means for the horizontal unit distribution of the blanks, said conveyor means being maintained in a fixed overall relative position below said plurality of magazines;

magazine-selection means for selecting an operational magazine from said plurality of magazines;

a plurality of movable transfer means for grasping the lowest blank from said operational magazine, extracting the lowest blank from said lower extraction orifice of said operational magazine, and bringing the extracted blank to said conveyor means, said transfer means being movable up and down, and each of said transfer means being associated functionally and structurally with one of said plurality of magazines;

driving means for shifting said transfer means; and transfer-selection means for selecting the transfer means associated with said operational magazine, whereby said driving means shift only the selected transfer means.

7. The apparatus of claim 6, said magazines being identical and adapted to receive blanks of identical format.

8. The apparatus of claim 6, said magazines being different sizes and adapted to receive blanks of different formats.

9. The apparatus of claim 6, said conveyor means comprising movable means for longitudinally sliding the blanks, said movable means comprising at least one flexible, endless, non-extendable, filamentary connection extending in unitarily opposite said extraction orifices of said plurality of magazines and at least one stud means supported by said at least one filamentary connection for driving the blanks, said movable means being set transversely apart from said transfer means, and said apparatus further comprising drive member means for driving said movable means.

10. The apparatus of claim 6, further comprising blank-selection means for selecting a group of blanks, said blank-selection means controlling said magazine-selection means and said transfer-selection means.

11. Apparatus for packaging contents in containers consisting of boxes, containers, or crates produced from blanks, comprising:

a plurality of packaging contents in containers consisting of boxes, containers, or crates produced from blanks, comprising:

a plurality of magazines arranged next to and aligned with one another and adapted to receive the plurality of stacks of blanks, each of said magazines having a lower extraction orifice;

linear, continuous first conveyor means for the horizontal unit distribution of the blanks, said first conveyor means and said plurality of magazines being in a fixed overall relative position, said first conveyor means comprising first longitudinal drive means for sliding the blanks and first lateral means for longitudinally guiding the blanks;

magazine-selection means for selecting an operational magazine from said plurality of magazines;

a plurality of movable transfer means for grasping the lowest blank from said operational magazine, extracting the lowest blank from said lower extraction orifice of said operational magazine, and bringing the extracted blank to said first conveyor means, each of said transfer means being associated functionally and structurally with one of said plurality of magazines;

driving means for shifting said transfer means;

transfer-selection means for selecting the transfer means associated with said operational magazine, whereby said driving means shift only the selected transfer means;

packaging means for constructing a container from the distributed blank and placing the contents in the container, said packaging means being positioned upstream of said magazines, said first conveyor means, said magazine-selection means, said transfer means, said driving means, and said transfer-selection means, and said packaging means including second conveyor means for conveying the container, said second conveyor means being an extension of said first conveyor means and comprising second longitudinal drive means for sliding the containers and second lateral means for longitudinally guiding the containers, the spacing between said first and second lateral means being identical.

12. The apparatus of claim 11, said second lateral means having adjustable transverse spacing.

13. The apparatus of claim 11, said first longitudinal drive means having an upstream end and a downstream end, and said first conveyor means including stud means for driving the blanks and means for retracting said stud means at said downstream end of said first longitudinal drive means.

* * * * *